United States Patent [19]

Garmong

[11] 4,431,122

[45] Feb. 14, 1984

[54] GUN SUPPORT

[76] Inventor: Frank Garmong, R.D. 5, 422 East, Kittanning, Pa. 16201

[21] Appl. No.: 493,955

[22] Filed: May 12, 1983

[51] Int. Cl.[3] ..... F41C 29/00

[52] U.S. Cl. ..... 224/268; 224/150; 224/913

[58] Field of Search ..... 224/150, 149, 268, 913

[56] References Cited

U.S. PATENT DOCUMENTS

| | | | |
|---|---|---|---|
| 612,298 | 10/1898 | Zuberbier | 224/268 X |
| 2,574,143 | 11/1951 | Colby | 224/268 X |
| 3,211,351 | 10/1965 | Somple | 224/150 |

*Primary Examiner*—Steven M. Pollard

*Attorney, Agent, or Firm*—Carothers & Carothers

[57] ABSTRACT

A gun support and more particularly a multipurpose sling-type gun support for use in supporting an elongated hand-held firearm.

14 Claims, 3 Drawing Figures

GUN SUPPORT

This invention related to a novel and improved support apparatus for support of a gun being carried by a hunter or other user such as an infantryman on maneuvers.

Prior sling-type gun carriers are known, for example such as shown in U.S. Pat. Nos. 612,298, 695,176 and 2,574,143.

A broad primary object of this invention in common with the effect of prior sling-type gun carriers is to provide a gun support or carrier which is light in weight, simple of structure and convenient to use for maintaining reliable and comfortable support of the gun without interferring with its normal use in any way. Unlike the prior art, however, the present invention offers novel improvements which afford the user heretofore unavailable enhancement of gun support and use by virtue of novel features which combine to provide a multipurpose gun support wherein the gun support capability, which is but one of several useful functions of the carrier, is an improved and more utilitarian support capability over prior art sling-type gun carrier devices. For example, the present invention may include some or all of the following capabilities in addition to a gun carrying capability: a temporary or substitute arm sling if injured at war or in the woods, a breech and/or scope cover for protection of these important items from moisture, a hand warmer, a storage compartment, a tie ring for attachment of a dog leash, and a tie ring for manual lifting or dragging of heavy loads such as a deer carcass and a safety or warning capability.

Other objects and advantages appear in the following description and claims.

The accompanying drawings show, for the purpose of exemplification without limiting the invention or the claims thereto, certain practical embodiment illustrating the principles of this invention wherein:

Figure 1:
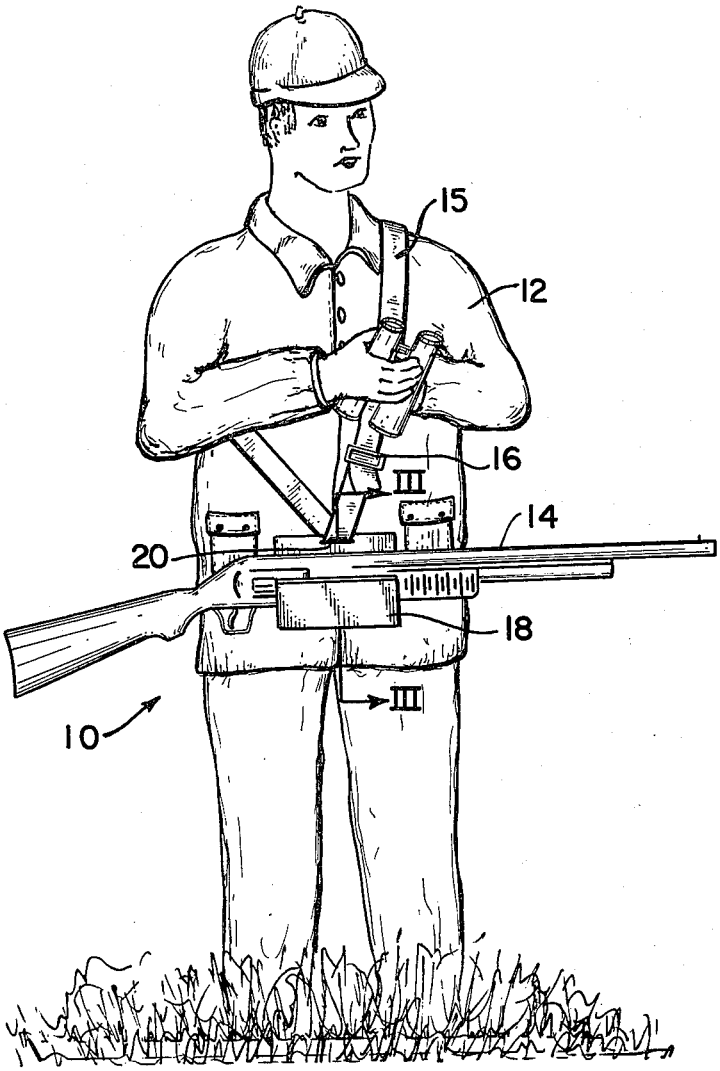
FIG. 1 is a pictorial elevation of a hunter utilizing a gun carrier of the present invention.
Figure 2:
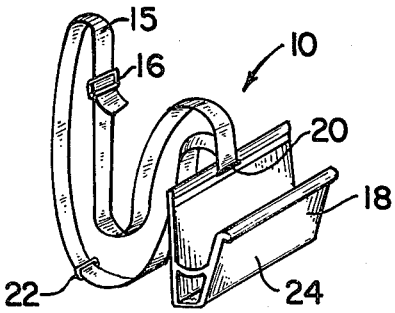
FIG. 2 is a perspective view of a gun carrier according to the present invention.

There is generally indicated at 10 in FIGS. 1 and 2 a gun carrier according to one presently preferred embodiment of the instant invention and shown in FIG. 1 being worn by a hunter 12 whose rifle 14 is resting in a cradle 18 of carrier 10. Hunter 12 supports carrier 10 by means of a flexible strap 15, preferably an adjustable length strap as by means of an included conventional slide buckle assembly 16. The strap 15 thus is adjustable by the user to a suitable length to be passed over one shoulder of the user and under his opposite arm whereby the strap 15 supports cradle 18 at any suitable, selected height. Strap 15 is preferably of a bright color such as fluorescent red or orange to serve as a highly visible warning to other hunters thus providing an important safety feature.

Cradle 18 is preferably fabricated from such suitable material as extruded aluminum, extruded or molded plastic material, or the like, limited only by the wear strength and rigidity specifications which would be considered necessary to provide the desired gun support function and other functions of the carrier 10. From the figures it will be seen that cradle 18 is generally elongated for enhanced gun support and for other purposes to be described hereinbelow, and includes a central longitudinal slot 20 through which strap 15 passes and is slideable lengthwise therein whereby the cradle 18 is freely slideable on strap 15 between a front position as shown in FIG. 1 and a side position (not shown) or other suitable positions. Specifically, the sliding capability of cradle 18 along strap 15 permits user ease in bending, stooping or sitting without disturbing the gun support function of cradle 18. Of course, for proper support gun 14 preferably would be placed within cradle 18 with its balance point vertically aligned with slot 20.

From FIG. 2 it will be seen that carrier 10 further includes an anchor means such as a "D" ring 22 which is freely slideable on strap 15 so as not to interfere with the sliding of cradle 18 thereon. Ring 22 provides a tie point for a dog leash to control a dog while loading or unloading a firearm, or walking to and from woods, or a rope or other suitable line being utilized to lift, haul, or drag a load such as an animal carcass. This hauling or dragging capability is available without disturbance of the gun carrying capability of carrier 10 due to the available sliding motion of cradle 18 and ring 22 along strap 15. Cradle 18 is capable and designed in such a manner that it can serve as an arm sling if an arm, hand or finger injury is incurred while in combat or during hunting by adjusting the strap up.

Figure 3:
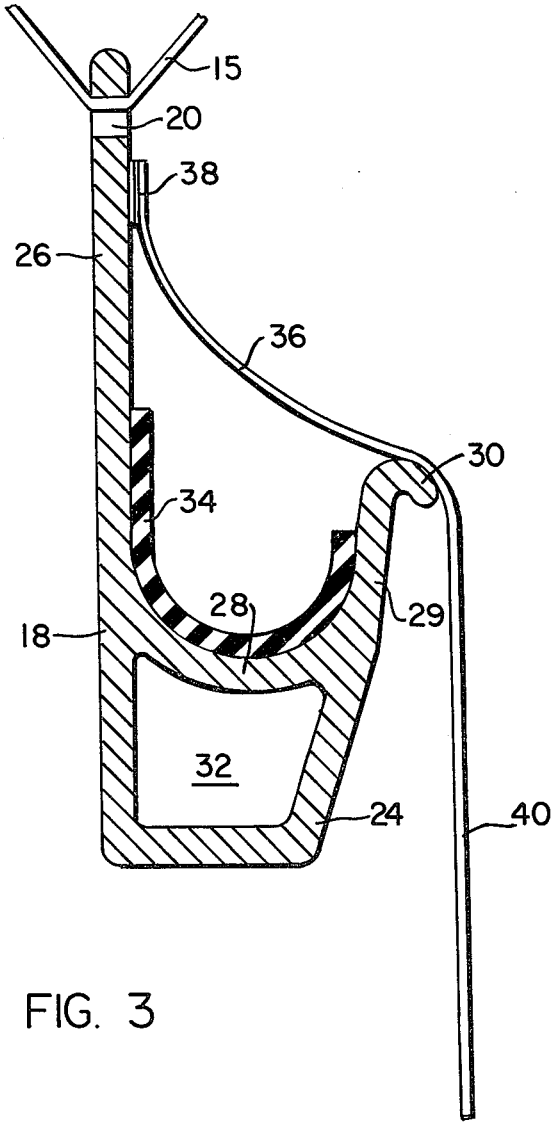
FIG. 3 is a sectional view taken on line III—III of FIG. 1 with the gun removed for clarity of illustration.

Referring to FIGS. 2 and 3, cradle 18 includes an elongated body 24 having an upstanding hanger portion 26, a support pocket portion 28 depending from hanger portion 26 and within which gun 14 may be supported, and an outer upstanding portion 29 which terminates in a lip 30. The slot 20 is formed centrally of the longitudinal extent of body 24 adjacent the upermost extent of hanger portion 26 whereby the weight of a gun cradled in pocket portion 28 is suspended below the point of suspension of cradle 28 upon strap 15. A storage compartment 32 is formed beneath pocket portion 28 by downwardly projecting extensions of hanger portion 26 and portion 29. The storage compartment 32 may include end closures of desired (not shown) for positive retention of the contents thereof.

A formed pad 34 of soft rubber or the like is secured as by an adhesive material within pocket portion 28 in conformity therewith and preferably coextending longitudinally therewith throughout the length of cradle 18. Pad 34 permits cushioned support of the gun carried in pocket 28 and protects the gun from superficial damage such as marring or scratching which might otherwise result from direct contact with the material forming body 24.

A flexible cover 36 shown only in FIG. 3, is provided to cover the gun carried in pocket 28. The cover 36 may be of such suitable material as waterproof canvas and may be removably affixed to hanger portion 26 beneath slot 20 as by a hook and loop type fastener system 38, (e.g. velcro fastener) or alternatively by snaps or other such fastener means.

Cover 36 is at least as long as body 24 and preferably longer whereby it may cover such important items as the breech of the rifle, the scope, the hammer and pan of a flintlock type muzzleloader, or the like. It therefore affords the capability of, for example, protecting the scope without need of sheltering it under ones coat (which can result in fogging of the scope lenses upon use), protecting the breech and firing mechanism from moisture, keeping the power load in the pan of a flintlock muzzleloader dry and ready for firing, prevention of freezing of moving parts in extremely cold weather, and the like.

When not in use the cover 36 may be removed as described above or may be simply formed into pocket 28 to provide added cushioning for the gun carried therein. An additional feature of the cover 36 is that it may serve as a hand warmer by being used as a cover for the hands of the user. Yet another functional feature of cover 36 is that, like strap 15, it may be of fluorescent red or orange or other suitable warning color to serve as a safety marking for the user. The cover 36 includes sufficient overhand 40 to readily permit its use as a hand warmer and to provide its described safety marking function even when not in use and folded into pocket 28 as described above. An additional feature of cover 36 is that it may serve as a safety cover to be draped over the side of a dead animal carcass during field dressing, it also can be used to signal for help.

According to the description hereinabove there is provided by the instant invention a novel and improved multipurpose sling-type gun carrier offering combined capabilities and features not heretofore available. Inasmuch as a presently preferred embodiment of the invention has been described hereinabove, it will be appreciated that the invention is capable of expression in various alternative and modified embodiments. As many such alternative embodiments have been envisioned and anticipated by the inventor, it is intended that the invention be construed as broadly as permitted by the scope of the claims appended hereto.

I claim:

1. A gun support for carrying an elongated firearm, said support comprising:

an elongated body member;

upwardly open elongated pocket means formed in said body member and extending longitudinally thereof and adapted to receive therein an elongated firearm for support of such elongated firearm adjacent the balance point thereof with said body extending longitudinally in opposite directions from such balance point;

cushion means disposed in said pocket means and conforming therewith to cushion the support therein of such elongated firearm;

adjustable, flexible support strap means engaging said body member intermediate the longitudinal ends thereof and above said pocket means whereby said body member and an elongated firearm carried thereby may be suspended from said strap means;

and flexible cover means carried by said body member in a position to permit said cover means to overlie said pocket means to protect at least those portions of such elongated firearm located intermediate the longitudinal ends of said body member.

2. The support as claimed in claim 1 wherein said body member is slideable on said strap means.

3. The support as claimed in claim 2 wherein said strap means serves as a safety marker for the user of said support.

4. The support as claimed in claim 3 wherein said strap means includes a brightly colored surface portion which may be exposed when said support is in use.

5. The support as claimed in claim 4 wherein said strap means is a shoulder strap means which may be worn with said colored surface portion exposed.

6. The support as claimed in claim 5 wherein said cover means serves as a safety marker for the use of said support.

7. The support as claimed in claim 6 wherein said cover means includes a brightly colored surface portion which may be exposed when said cover means is in use.

8. The support as claimed in claim 7 including selectively releasable fastener means for selectively securing and removing said cover means from said body member.

9. The support as claimed in claim 8 additionally including storage compartment means formed in said body member.

10. The support as claimed in claim 9 wherein said storage compartment means extends longitudinally of said body member beneath said pocket means.

11. The support as claimed in claim 10 additionally including an anchor means captively retained by said strap means and freely slidable thereon.

12. The support as claimed in claim 11 wherein said anchor means is a D-ring which encompasses said strap means and is thereby slidable thereon.

13. The support as claimed in claim 12 wherein said body member is an extruded member.

14. The support as claimed in claim 12 wherein said body member is a molded member.

* * * * *